US007256758B2

(12) United States Patent
Hu et al.

(10) Patent No.: US 7,256,758 B2
(45) Date of Patent: Aug. 14, 2007

(54) APPARATUS AND METHOD OF AC DRIVING OLED

(75) Inventors: Shuo-Hsiu Hu, Tainan (TW); Li-Wei Shih, Chiai (TW); Chiao-Ju Lin, Taichung (TW); Wen-Kuen Chen, Jubei (TW)

(73) Assignee: AU Optronics Corporation, Hsinchu (TW)

( * ) Notice: Subject to any disclaimer, the term of this patent is extended or adjusted under 35 U.S.C. 154(b) by 166 days.

(21) Appl. No.: 10/452,442

(22) Filed: Jun. 2, 2003

(65) Prior Publication Data

US 2004/0239664 A1 Dec. 2, 2004

(51) Int. Cl.
*G09G 3/32* (2006.01)

(52) U.S. Cl. ..... 345/82; 345/211

(58) Field of Classification Search ..... 345/82, 345/83, 74.1, 76, 77, 79, 204, 211; 315/169.1, 315/169.3

See application file for complete search history.

(56) References Cited

U.S. PATENT DOCUMENTS

| | | | | |
|---|---|---|---|---|
| 5,391,904 | A | 2/1995 | Asami et al. | |
| 6,680,580 | B1 * | 1/2004 | Sung | 315/169.3 |
| 6,734,636 | B2 * | 5/2004 | Sanford et al. | 315/169.3 |
| 2001/0024186 | A1 * | 9/2001 | Kane et al. | 345/98 |
| 2002/0101395 | A1 * | 8/2002 | Inukai | 345/83 |
| 2002/0180671 | A1 | 12/2002 | Inukai | |
| 2002/0195968 | A1 * | 12/2002 | Sanford et al. | 315/169.3 |
| 2002/0195988 | A1 | 12/2002 | Sanford et al. | |
| 2003/0063054 | A1 * | 4/2003 | Inukai | 345/83 |
| 2003/0095087 | A1 * | 5/2003 | Libsch et al. | 345/82 |
| 2003/0107565 | A1 * | 6/2003 | Libsch et al. | 345/211 |
| 2003/0146888 | A1 * | 8/2003 | Yamazaki et al. | 345/82 |
| 2003/0197665 | A1 * | 10/2003 | Sung | 345/82 |
| 2004/0004589 | A1 * | 1/2004 | Shih | 345/82 |
| 2004/0080474 | A1 * | 4/2004 | Kimura | 345/82 |
| 2004/0174349 | A1 * | 9/2004 | Libsch et al. | 345/204 |

FOREIGN PATENT DOCUMENTS

| | | | |
|---|---|---|---|
| JP | 1999008064 | A | 1/1999 |
| JP | 2001142413 | A | 5/2001 |
| JP | 2002040963 | A | 2/2002 |
| JP | 2002169509 | A | 6/2002 |
| JP | 2002169510 | A | 6/2002 |
| JP | 2004117648 | A | 4/2004 |

OTHER PUBLICATIONS

J. Shen et al. "Degradation mechanisms in organic light emitting diodes," Synthetic Metals 111-112 (2000) 233-236.

* cited by examiner

*Primary Examiner*—Regina Liang
(74) *Attorney, Agent, or Firm*—Duane Morris LLP

(57) ABSTRACT

An apparatus and method for providing switched power to an AMOLED is disclosed. During certain time intervals, voltage and/or polarity provided to active devices such as thin film transistors (TFT) driving the AMOLEDs may be changed to reverse polarity or differ in absolute magnitude of voltage. During a subsequent time interval, the changed power may be changed again and/or reverted to an original state. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

4 Claims, 4 Drawing Sheets

APPARATUS AND METHOD OF AC DRIVING OLED

FIELD OF INVENTION

The present invention relates to a circuit and method for driving an organic light emitting diode using alternative voltages and/or currents.

BACKGROUND OF THE INVENTION

Many displays useful for presenting information are based on light emitting diodes, including organic light emitting diodes (OLED) and active matrix organic light emitting diodes (AMOLED).

Typically, drive voltages of OLEDs rise with time during operation. The OLED's brightness tends to decay and the voltage variation of the node which connects OLEDs to their driving thin film transistors (TFT) also affect the operation of that TFT.

Once the voltage of the TFT varies, e.g. its drain or source voltage, the driving current of the TFT decreases under the same grey-level data input. This all tends to decrease the brightness of the display over time.

Referring now to FIG. 1, in typical methods for driving OLED displays, the system power $V_{DD}$ is always higher than $V_{SS}$, because typical OLEDs can be turned on only in this state. Further, $V_G$, the gate voltage of a TFT, is always between $V_{DD}$ and $V_{SS}$. In this state, the TFT will accumulate electric charges gradually and the lifetime of the OLED will concurrently be decreased gradually. However, this method is not desirable for use with displays using AMOLED displays.

DETAILED DESCRIPTION OF THE PREFERRED EMBODIMENT

Figure 2A:
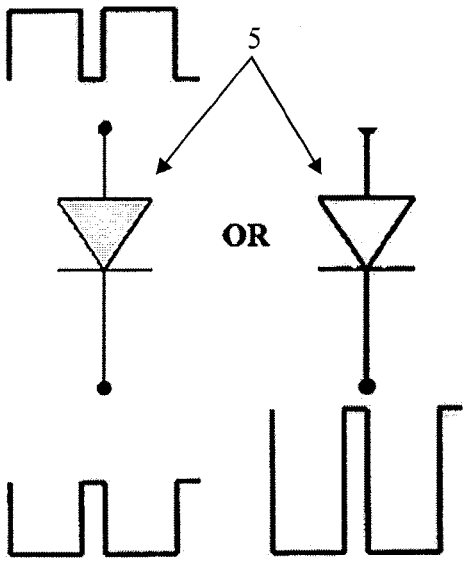
FIG. 2*a* and FIG. 2*b* are schematic illustrations of power cycles according to the present invention.
Figure 2B:
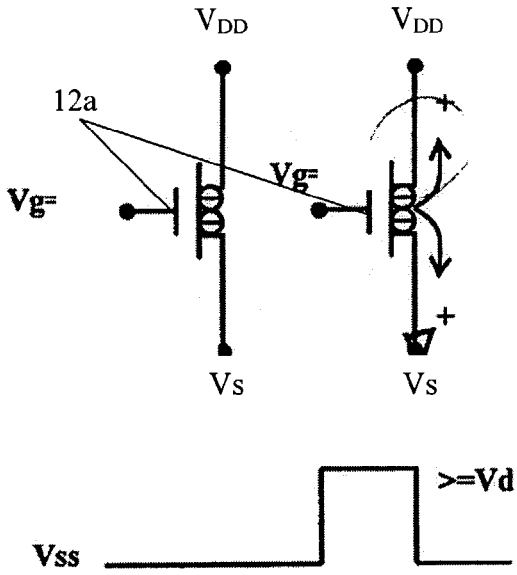

Referring now to FIG. 2*a* and FIG. 2*b*, diode 5, e.g. an OLED or other organic light emitting device, may be subjected to an appropriate voltage shift to perform a reverse bias stressing, as will be familiar to those in the art, leading to retardation of degradation in OLED and AMOLED devices. A reverse biasing operation may also be performed on an associated TFT's gate, illustrated at 12*a* in FIG. 2*b*, as will be familiar to those in the art.

Figure 3:
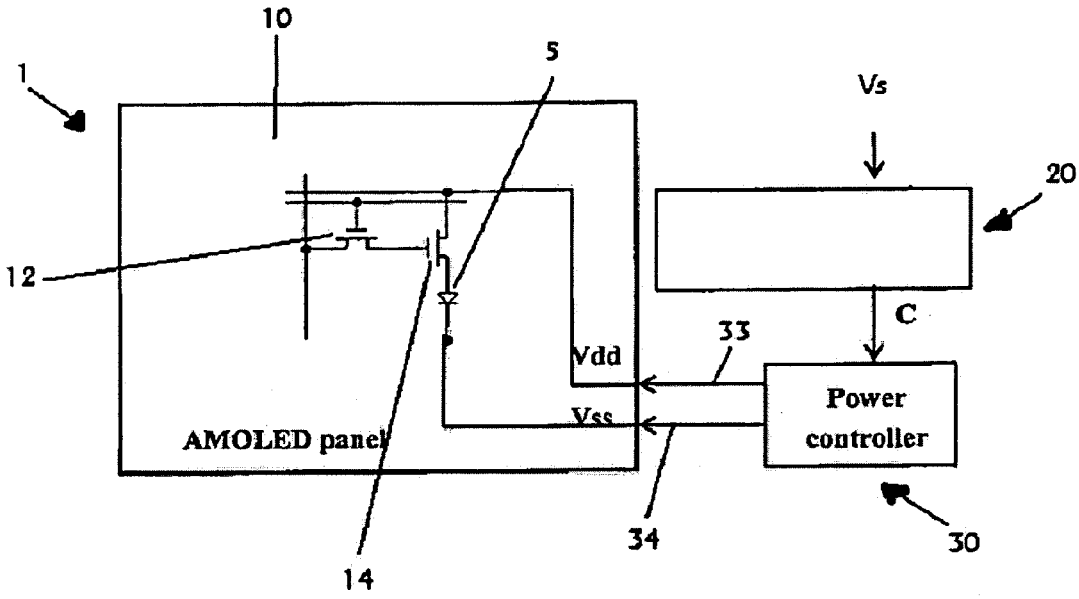
FIG. 3 is a schematic diagram of a system for implementing the present invention.

Referring now to FIG. 3, system 1 for providing an active matrix organic light emitting diode (AMOLED) display comprises controller circuit 20, power controller 30 operatively in communication with controller circuit 20, and AMOLED display 10 operatively in communication with power controller 30. TFT devices 12 and 14 may be present to drive AMOLED 5.

Controller circuit 20 may be a controller circuit such as a complex programmable logic device (CPLD), a field programmable grid array (FPGA), a microcontroller, or the like.

Power controller 30 further comprises at least one bipolar power source 32 (not shown in the figures). As used herein, a bipolar power source means that the power source is capable of switchably providing either a positive voltage, a negative voltage, or both a positive and a negative voltage. In a preferred embodiment, bipolar power source 32 comprises at least two separate power sources 33,34 where at least one of bipolar power sources 33, 34 is capable of providing either a positive or a negative voltage. Further, power controller 30 preferably provides a first voltage and a second voltage where a voltage potential between the first voltage and the second voltage is switchable between a positive value and a negative value at a predetermined switching time interval.

Figure 4:
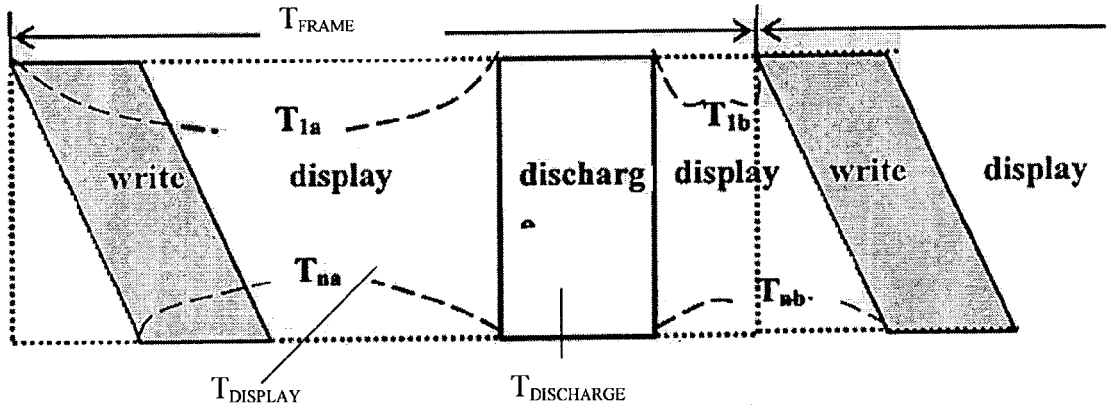
FIG. 4 is an exemplary timing diagram.

Referring to FIG. 4, for use with AMOLED display 10, the predetermined switching time may comprise a writing and display period $T_{DISPLAY}$, a discharge period $T_{DISCHARGE}$, or the like, or a combination thereof. In a preferred embodiment, a timing ratio useful for the discharge period is given by the formula $(T_{DISCHARGE})/T_{FRAME}$ where $T_{FRAME}$ is a time interval for a combined writing and display period and discharge period. Further, the voltage potential may be vary between positive and negative values during predetermined times, e.g. greater than zero during writing and display period $T_{DISPLAY}$ or less than zero during discharge period $T_{DISCHARGE}$. As can be seen from the timing diagram. T1a is the time from the beginning of writing data to the first row until discharge begins. T1b is the time from end of the discharge of the first row to the beginning of writing data for the next frame. Tna is the time from beginning writing data for the $n^{th}$ row until the start of discharge for that $n^{th}$ row. Tnb is the time from the end of the discharge of the $n^{th}$ row until data begins to be written for the next frame. The time (T1a+T1b) will usually be the same as (Tna+Tnb).

In the operation of an exemplary embodiment, power may be provided to an AMOLED by providing first power source 33 (FIG. 3) and second power source 34 (FIG. 3) where each power source 33,34 is adapted to power an anode/cathode pair such as for a component of the AMOLED display, a source/drain pair such as for field effect transistor, or the like, or a combination thereof. A first voltage having a predetermined polarity and a magnitude is provided to first power source 33, e.g. to supply $V_{DD}$ voltage, and a second voltage having a predetermined polarity and a magnitude is provided to second power source 34, e.g. to supply $V_{SS}$ voltage. At a predetermined time interval, power controller 30 may change at least one of the polarity of first power source 33, the polarity of second power source 34, the polarity of both the first power source 33 and second power source 34, the magnitude of the first voltage, or the magnitude of the second voltage. As will be understood by those in the art, changing the first voltage and/or the second voltage means changing the absolute value of the magnitude of the voltage, e.g. from 6 volts to 12 volts. In an embodiment, changing the voltage comprises making the voltage of first power source 33 equal to the voltage of second power source 34.

For example, voltage from first power source 33 may be provided to a drain of N-type TFT 14 while voltage from second power source 34 is provided to a source of N-type TFT 14. During a discharge period, the voltage of first power source 33 may be changed to be greater than or equal the voltage of second power source 34. Similarly, for a P-type TFT, during a discharge period, the voltage of first power source 33 may be changed to be less than or equal the voltage of second power source 34.

Figure 1:
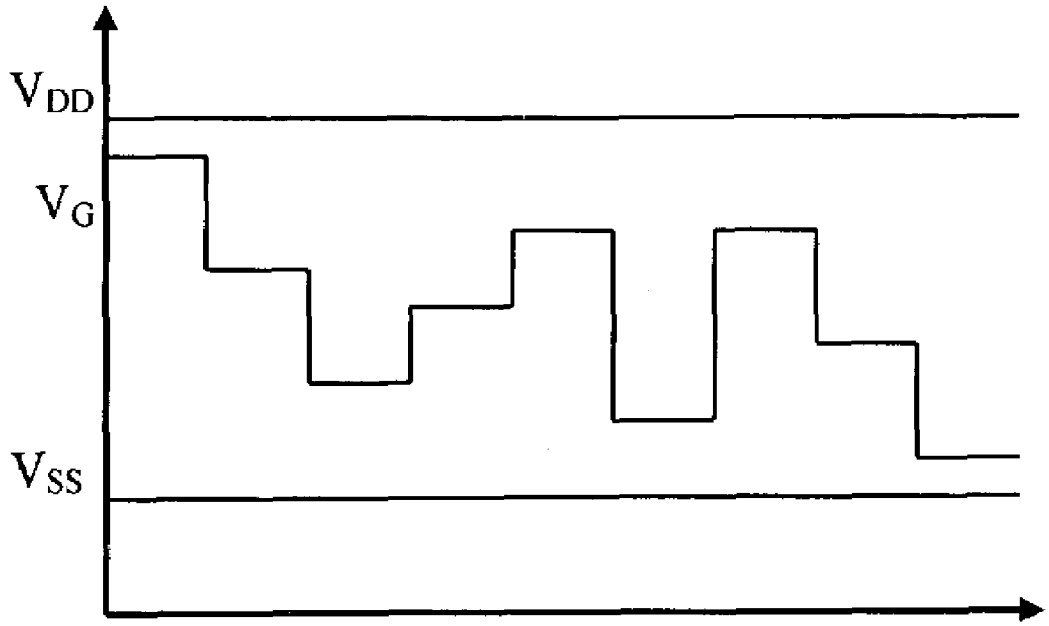
FIG. 1 is an exemplary timing diagram of prior art voltage swings used in driving organic light emitting diode (OLED) displays.

In an alternative embodiment, AMOLED display 10 (FIG. 1) may be controlled by providing first power source 33 and second power source 34 by power controller 30, where each power source 33,34 is adapted to power an anode/cathode pair of a component of the AMOLED display, a source/drain pair of a transistor, or the like, or a combination thereof. A first voltage having a predetermined polarity and magnitude is provided to first power source 33 and a second voltage having a predetermined polarity and magnitude is provided to second power source 34.

Start signal of a frame $V_S$ may be provided to controller circuit 20 and a timer (not shown in the figures) begun upon receipt of start signal $V_S$. First control signal C may be sent by controller circuit 20 to power controller 30 upon lapse of a first predetermined time interval where the lapse is determined using the timer. Upon receipt of control signal C, power controller 30 may change the polarity of first power source 33, the polarity of second power source 34, the polarity of both first power source 33 and second power source 34, the magnitude of the first voltage, the magnitude of the second voltage, or the like, or a combination thereof.

Additionally, a second timer (not shown in the figures) may be initiated upon the lapse of the first predetermined time interval. When a second predetermined interval elapses as determined by the second timer, controller circuit 20 may send a second control signal (not shown in the figures) to power controller 30. Upon receipt of the second control signal, power controller 30 may change the polarity of first power source 33, the polarity of second power source 34, the polarity of both first power source 33 and second power source 34, the magnitude of the first voltage, the magnitude of the second voltage, or the like, or a combination thereof. In an embodiment, if a voltage was changed upon receipt of first control signal C, upon receipt of the second control signal the changed voltage may be changed back to its original value.

It will be understood that various changes in the details, materials, and arrangements of the parts which have been described and illustrated above in order to explain the nature of this invention may be made by those skilled in the art without departing from the principle and scope of the invention as recited in the appended claims.

We claim:

1. A method of controlling an active matrix organic light emitting diode (AMOLED) display, comprising:

a. providing, by a power controller, of a first power source and a second power source, each power source adapted to power at least one of (i) an anode/cathode pair of a component of the AMOLED display or (ii) a source/drain pair of a transistor;

b. providing a first voltage having a predetermined polarity by the first power source;

c. providing a second voltage having a predetermined polarity by the second power source;

d. providing a start signal of a frame to a controller circuit operatively in communication with the power controller;

e. beginning a timer upon receipt of the start signal;

f. sending a first control signal by the controller circuit to the power controller upon lapse of a first predetermined time interval, the lapse being determined using the timer;

g. changing by the power controller, upon receipt of the control signal, of at least one of (i) the polarity of voltage of the first power source, (ii) the polarity of voltage of the second power source, (iii) the polarity of the voltage of both the first power source and the second power source, (iv) a magnitude of the first voltage, or (v) a magnitude of the second voltage.

2. The method of claim 1, further comprising:

a. beginning a second timer when the first predetermined time interval lapses;

b. sending a second control signal by the controller circuit to the power controller when second predetermined time lapses, the lapse being determined using the timer;

c. changing by the power controller, upon receipt of the second control signal, of at least one of (i) the polarity of the voltage from the first power source, (ii) the polarity of the voltage from the second power source, (iii) the polarity of voltage from the both the first power source and the second power source, (iv) a magnitude of the first voltage, or (v) a magnitude of the second voltage.

3. The method of claim 2, wherein:

a. upon receipt of the second control signal, a changed voltage is changed back to its original value.

4. A system for providing an active matrix organic light emitting diode (AMOLED) display, comprising:

a. a controller circuit;

b. a power controller operatively in communication with the controller circuit, the power controller further comprising at least two bipolar power sources, each capable of switchably providing an associated positive voltage and an associated negative voltage;

c. an AMOLED display operatively in communication with and powered by the power controller;

d. means for providing a start signal ala frame to the controller circuit;

e. means for beginning a timer upon receipt of the start signal; and f. means for sending a first control signal to the power controller upon lapse of a predetermined time, causing action of at least one of the bipolar power sources, the lapse determined by the timer.

* * * * *

UNITED STATES PATENT AND TRADEMARK OFFICE

CERTIFICATE OF CORRECTION

PATENT NO. : 7,256,758 B2
APPLICATION NO. : 10/452442
DATED : August 14, 2007
INVENTOR(S) : Shuo-Hsiu Hu et al.

It is certified that error appears in the above-identified patent and that said Letters Patent is hereby corrected as shown below:

Column 4, line 45 in Claim 4, replace “ala” with --of a--

Signed and Sealed this

Third Day of June, 2008

JON W. DUDAS
*Director of the United States Patent and Trademark Office*